United States Patent [19]

Cain

[11] 3,982,864

[45] Sept. 28, 1976

[54] VACUUM PUMP

[75] Inventor: Robert L. Cain, Montpelier, Ohio

[73] Assignee: Robinair Manufacturing Corporation, Montpelier, Ohio

[22] Filed: Sept. 15, 1975

[21] Appl. No.: 613,361

[52] U.S. Cl. ..... 418/149; 29/156.4 R; 29/458; 418/67; 418/179

[51] Int. Cl.[2] ..... F04C 27/00

[58] Field of Search ..... 418/149, 178, 179, 67; 29/156.4 R, 458; 92/169

[56] References Cited

UNITED STATES PATENTS

| | | | |
|---|---|---|---|
| 2,243,464 | 5/1941 | Kucher | 29/156.4 R |
| 2,294,037 | 8/1942 | Kucher | 29/156.4 R |
| 2,611,323 | 9/1952 | Digney | 418/179 X |
| 2,620,553 | 12/1952 | Schultz | 29/156.4 R |
| 3,791,780 | 2/1974 | Fritch et al. | 418/67 X |

*Primary Examiner*—C. J. Husar
*Assistant Examiner*—Leonard Smith
*Attorney, Agent, or Firm*—Burton, Parker & Schramm

[57] ABSTRACT

A rotary mechanical vacuum pump has a pump chamber formed of aluminum which has been treated by hard anodizing the working surfaces of the pump chamber and the lapped mating surfaces between the parts surrounding the chamber, with a high vacuum grease applied to such mating surfaces and providing an effective seal against leakage between the pump chamber and the ambient atmosphere.

9 Claims, 4 Drawing Figures

VACUUM PUMP

FIELD OF INVENTION

This invention relates to improvements in rotary mechanical vacuum pumps, and in particular, to effecting a good seal at the interface between housing parts which cooperatively form the pump chamber.

BACKGROUND OF THE INVENTION

In the field of portable, rotary, mechanical vacuum pumps, there has been a need for some years for a small, lightweight, inexpensive pump suitable for use by refrigeration and air conditioning service personnel, a pump rated, for example, at one cubic foot of air per minute. As domestic refrigeration service is, for the most part, performed by a serviceman in the customer's home, portability and light weight are important considerations. As profit is determined by efficiency of the serviceman and his tools, a vacuum pump which will quickly draw down a refrigeration system to permit recharging, will reduce the serviceman's time on the job. Light weight will reduce his fatigue and therefor improve his efficiency. For the pump to be efficient and draw down quickly to its rated vacuum it must be free of atmospheric leakage. If the atmosphere can enter the pump, not only will it not draw down to its rated capacity, but even if the pump begins to approach its capacity, it will do so only slowly.

In constructing a rotary mechanical vacuum pump, it is conventional to construct the pump chamber from cooperating parts having flat opposed surfaces adjacent the areas of high vacuum which must be sealed against atmospheric leakage. Normal methods of sealing have been by use of resilient gaskets disposed between the surfaces, but these gaskets have a tendency to leak, generally because they are composed of a fiberous structure which provides a tortuous but nevertheless effective path for the flow of ambient air. Also, the gaskets are sometimes subject to out-gassing which in effect resembles an atmospheric leak.

In the design of rotary mechanical vacuum pumps, tolerances between moving parts become critical to prevent vacuum leaks. The use of gaskets between mating surfaces may allow some compression and therefore variation in the distance between surfaces and accordingly, may affect tolerances between the working parts within the pump chamber. Therefore, it is desirable to eliminate the use of gaskets in areas where variation in distance between mating surfaces would affect tolerances between moving parts.

To avoid these problems, it is customary to use what is known as a high vacuum grease on the mating surfaces and eliminate the gasket. This grease has a vapor pressure of $10^{-4}$mm of mercury or less at 30°C. The mating surfaces are ground or lapped to attain desired flatness and the grease spread on them and the surfaces clamped tightly together. Because of smoothness resulting from lapping, the grease tends to be squeezed out from between the surfaces leaving a dry seal which is subject to leakage. Thus, providing an inexpensive yet incompressible vacuum seal between flat mating surfaces adjacent high vacuum areas presents a difficult problem.

To reduce weight, it is desirable to utilize aluminum for the larger parts of the pump, such as the pump chamber housing. However, the softness of aluminum creates problems in wearability and because it scratches easily, mating surfaces which are to be sealed must be carefully protected prior to assembly to avoid a scratch which will permit atmospheric leakage into high vacuum areas.

I have discovered how to effect a simple and inexpensive high vacuum seal and good wearability while utilizing aluminum die cast parts.

SUMMARY OF THE INVENTION

In carrying out my invention, the housing for the vacuum pump is made from aluminum, as for example, cooperating die cast aluminum parts, suitably machined as desired, including grinding or lapping to effect flatness and thereby attain a mating fit around the periphery of the pump chamber. These parts are then subjected to a hard anodizing treatment to a depth of 1 or 2 mils. Following anodizing and prior to assembly, a high vacuum grease is spread on the mating surfaces and then the parts are clamped tightly together. Not only does the hard anodizing provide good wearing surfaces on the otherwise soft aluminum surfaces within the pump chamber, but surprisingly a very effective high vacuum seal is established at the lapped surfaces around the pump chamber. This seal is believed to result from the presence of a very thin film of the grease which remains on the mating surfaces and is not squeezed out as occurs in the prior art. Why the grease does not completely squeeze out and the thin film remains is not fully understood but definitely results from the hard anodizing of the mating surfaces.

A further advantage resulting from the aforesaid is that not only do the lapped surfaces resist scratching as a result of their increased hardness, but in addition, should a slight scratch occur on the lapped surfaces which extend from the pump chamber to the outer edge of the housing, and which would normally result in a vacuum leak, the scratch is filled by the grease and no leak occurs.

Other meritorious features will become apparent in the following description.

BRIEF DESCRIPTION OF PREFERRED EMBODIMENT

There is disclosed in U.S. Pat. No. 3,791,780, owned by the common assignee, a vacuum pump embodying the same general design as the pump herein disclosed. The disclosure of U.S. Pat. No. 3,791,780 is hereby incorporated by reference in the instant disclosure.

Figure 1:
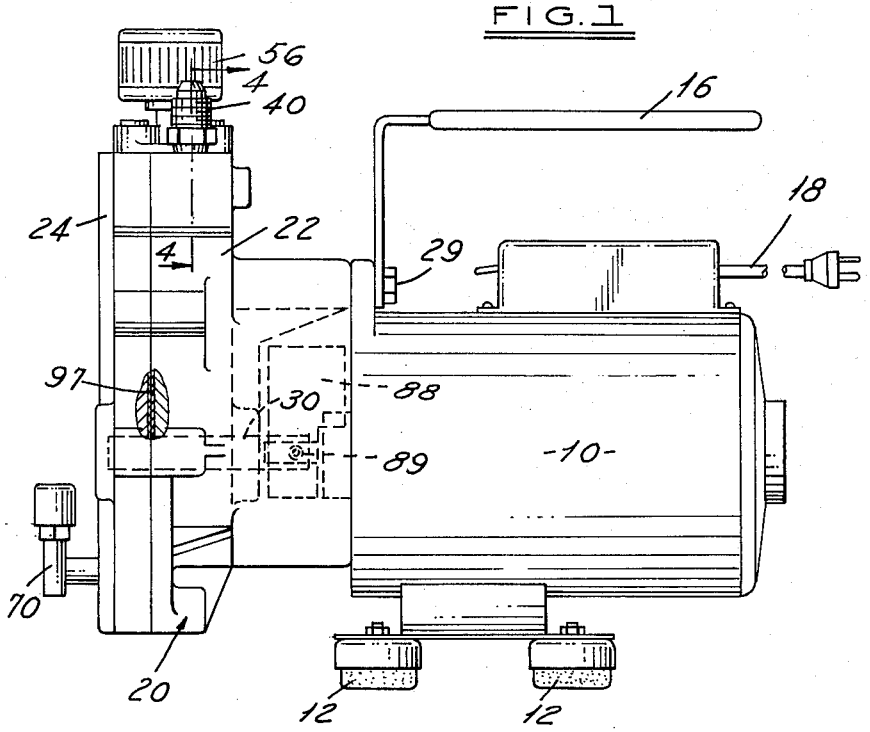
FIG. 1 is a side elevation partly in section of a vacuum pump embodying my invention.

As shown in FIG. 1, my improved vacuum pump includes an electric motor 10 mounted on four resilient feet 12, only two of which are shown, enabling the pump to rest on the floor. The center of mass of the electric motor 10 and the pump per se 20 is substantially centered over the feet 12 so that they are sufficient to support the pump in a cushioned fashion during its operation. A suitable handle 16 is provided to enable the serviceman to transport the pump easily during his service business. An electric plug-in cord 18 is provided.

Figure 3:
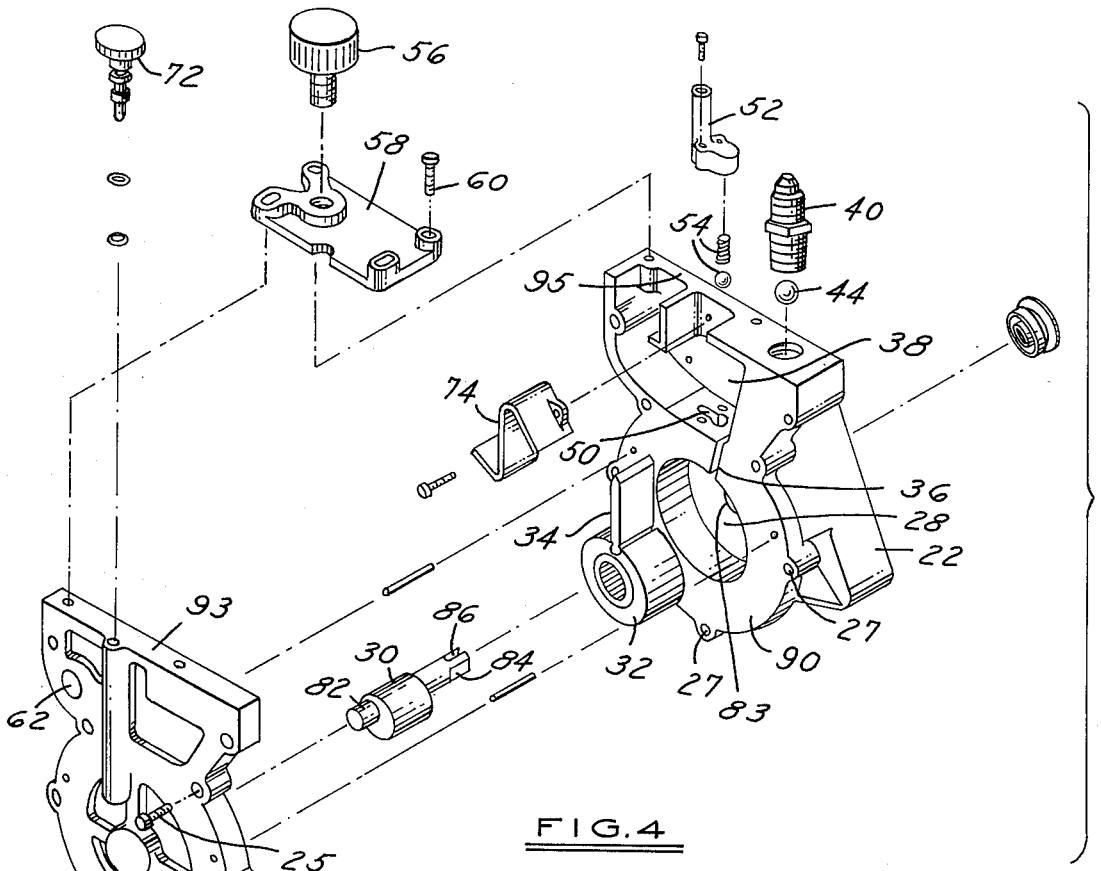
FIG. 3 is an exploded view of the principal elements of the pump.

The pump per se 20 comprises a pump chamber housing formed of aluminum die cast members 22 and 24 which are clamped tightly together by cap screws 25 passing through apertures 26 and threaded into bores 27. Member 22 is best shown in FIG. 3. It comprises a pumping chamber 28 within which is supported, on the eccentric of pump shaft 30, a rotary piston 32 which sweeps around the inside of the chamber in a manner best described in U.S. Pat. No. 3,791,780. A vane 34 attached to the periphery of the piston reciprocates within a slot 36 in the wall of pump chamber. The vane extends into an oil reservoir 38 above the chamber.

Figure 4:
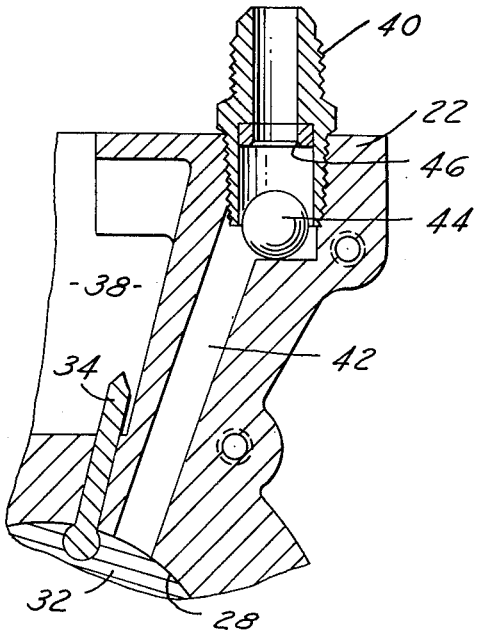
FIG. 4 is a cross-sectional view taken on the line 4—4 of FIG. 1.

As shown in FIG. 4 an inlet fitting 40 is threaded into the member 22 and communicates with a passageway 42 which opens at its lower end into the pump chamber 28 on one side of the vane 34. A valve ball element 44 buoyant in the pump oil, is disposed within the lower end of the fitting 40 and is adapted to valve seat 46 to prevent outward oil flow from within the pump back up through the inlet fitting.

An outlet from the pumping chamber 28 is shown at 50. It communicates with a fitting 52 containing a spring loaded valve assembly 54 which opens to permit air to be expelled from the pumping chamber when the pressure therein exceeds the force of the spring assembly 54. Air expelled from the chamber passes into the oil reservoir 38, formed in the top of member 22, and from thence outwardly through the exhaust muffler 56 mounted in a top closure cap 58 secured as by screws or the like 60 over the top of the oil reservoir to members 22 and 24.

Figure 2:
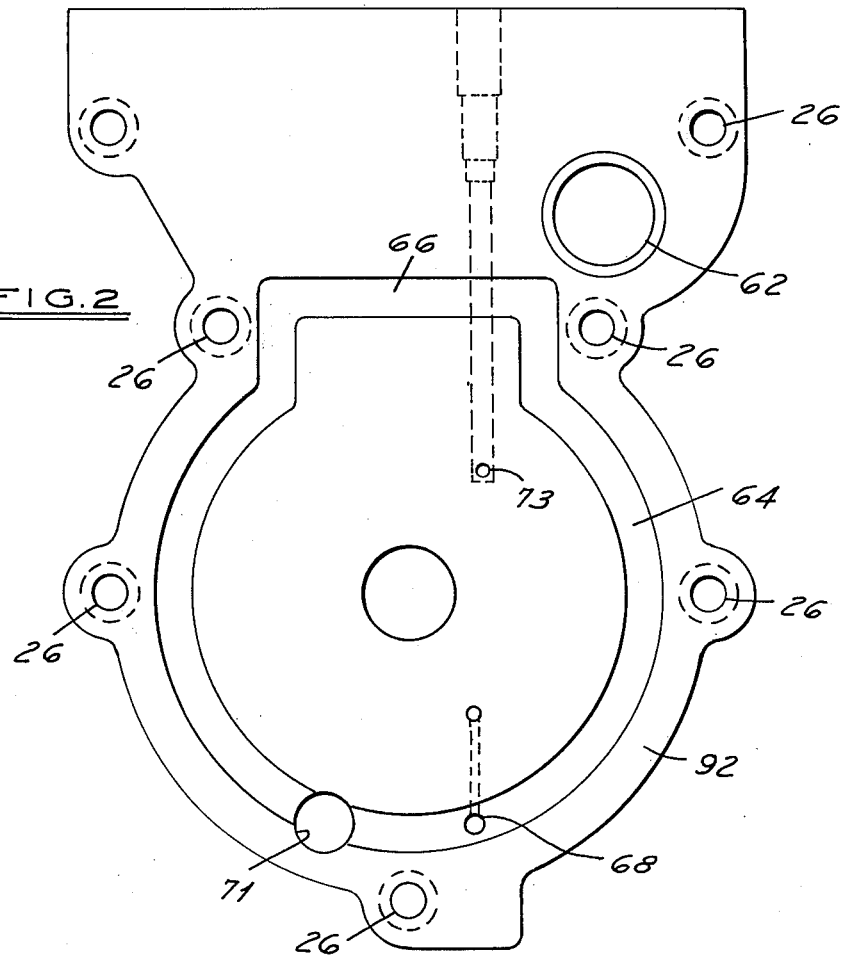
FIG. 2 is an inside elevation of a cover plate for the pumping chamber.

Member 24 of the pump serves as a cover or end plate for the pump chamber as best illustrated in FIGS. 2 and 3. It includes an oil level sight window 62 for inspecting the oil level within the reservoir 38. It also includes an oil groove 64 which surrounds the periphery of the pump chamber in outwardly spaced relation to assist in sealing the chamber and communicates at its upper portion 66 with the oil reservoir 38 whereby oil in the reservoir is circulated down through the groove to a passageway 68 which in turn communicates with the interior of the pumping chamber to establish oil circulation through the oil groove 64 as best described in U.S. Pat. No. 3,791,780. A drain valve 70 for draining the oil reservoir through the oil groove threads into the end plate as at 71. An air ballast valve may be provided as at 72 and 73 in FIGS. 2 and 3. An oil splash baffle is mounted in the oil reservoir as shown at 74.

The stub end 82 of eccentric piston shaft 30 is supported by a bearing in the member 24. The opposite end of the eccentric shaft is supported by a bearing and seal means in the aperture 83 in member 22, with the projecting end provided with a flat 84, a motor shaft receiving bore (not shown) and a cross slot 86 which receives a cross pin (not shown) in the motor shaft to facilitate connection with the shaft of the electric motor 10. A counterbalance shown in phantom outline at 88 in FIG. 1 is received over the pump shaft 30, and a set screw 89 in the counterbalance is tightened against the flat 84. Bolts such as bolt 29 serve to secure the pump to the motor with the shaft 30 telescoped over the motor shaft. The counterbalance 88 offsets the eccentric weight of the piston 32.

Members 22, 24 and 58 of the pump are preferably formed of aluminum, such as die cast aluminum. Following the casting, the opposed surfaces 90 and 92 (see FIGS. 2 and 3) of the members 22 and 24, and the top surfaces 93 and 95 and the underside of plate 58 are machined and lapped to be perfectly smooth and to fit in flat face-to-face engagement. Surfaces 90 and 92 when in flush face-to-face abutment define an interface 97, see FIG. 1, which has an edge exposed to the high vacuum in the pump and an opposite edge exposed to atmospheric pressure. Other machining operations, such as finishing the inside of the pumping chamber, drilling and tapping screw receiving holes are carried out. Following such machining and lapping, the die cast aluminum parts 22 and 24 are then subjected to a hard anodizing treatment such that the anodizing will penetrate the lapped surfaces as well as the interior machined surfaces of the pumping chamber to a depth of between 1 and 2 mils. Hard anodizing is a well known process for corrosion protection, and need not be herein described except to point out, by way of example, that it may employ a sulfuric acid bath containing from 10 to 15 percent acid by weight. The operating temperature of the bath may range from 32° to 50°F. with a current density of between 20 and 36 amperes per square foot. Higher temperatures cause the formation of soft and more porous outer layers of the anodic coating, reducing wear resistance significantly and tending to limit coating thickness. Excessive operating temperatures result in dissolution of the coating and can burn and damage the work.

Proprietary processes for hard anodizing may be employed. One of the more common of those processes utilizes a solution containing from 16 to 21 ounces of sulfuric acid and 1.6 to 2.8 ounces of oxalic acid $H_2C_2O_4$ per gallon of water. This solution is operated at 50°±2°F and a current density of 25 to 36 amps per square foot (voltage is increased gradually from 0 to between 40 and 60 volts). The treatment time is preferably approximately 25 minutes per mil of coating thickness.

Following the hard anodizing treatment of parts 22 and 24 a high vacuum grease is spread on the mating and lapped surface. This grease is commercially available. It should possess a vapor pressure of less than about $10^{-4}$mm of mercury at 30°C. Following application of the high vacuum grease and assembly of the parts, the elements 22, 24 and 58 are bolted together to bring the mating surfaces into snug, firm contact.

Testing vacuum pumps manufactured according to the foregoing teachings has shown they possess a surprising capability of sealing at the lapped and mating surfaces. While I am uncertain as to why this improved sealing is effective, it is my belief that the hard anodizing produces microscopic pockets in the surface of the aluminum and when the high vacuum grease is coated on such surfaces, these microscopic pockets accept the grease and hold it during the clamping of the mating surfaces together. These microscopic pockets in effect serve to trap small quantities of the grease and function as reservoirs for capillar movement of the grease between the mating surfaces where there is any space whatever into which the grease may capillate, such as scratches, slight imperfections, slight unevenness and the like, otherwise sufficient to permit the leakage of minute quantities of atmosphere into the pump chamber. With the high vacuum grease in the microscopic pockets serving as reservoirs for the grease to move by capillary action into any small spaces or voids between the mating surfaces, a good vacuum seal is effected around the pump chamber.

In addition, the hard anodized surfaces of the elements 24 and 24 around the pump chamber will resist accidental scratching during assembly of the pump. As a result leakage through accidental scratching is greatly reduced.

It will be understood that the hard anodizing in addition to making possible a very effective vacuum seal, also serves to substantially increase the wear resistance of the otherwise quite soft internal surfaces of the pumping chamber. As a consequence, the advantages of light weight afforded by the substrate of aluminum are combined with the durability of the hard wear resistant surfaces.

What is claimed is:

1. The method of sealing the interface between a pair of members against atmospheric leakage in the presence of a vacuum, at least one of which members is aluminum, comprising: machining the faces to a flush and lapped or mated condition, hard anodizing the machined face of the aluminum member, coating the anodized face with a high vacuum grease, and clamping the faces tightly together.

2. A rotary mechanical vacuum pump comprising: a plurality of aluminum members cooperatively defining a pumping chamber, said members being clamped tightly together and having opposed flat faces arranged in flush mating engagement with an edge of the interface between the faces exposed to the pumping chamber and an opposite edge exposed to ambient atmosphere, said faces and walls of the pumping chamber being hard anodized, and a vacuum grease having a vapor pressure of at least about $10^{-4}$mm mercury at 30°C disposed on said opposed flat faces.

3. In a vacuum pump, a pump body assembly formed of cooperating members having opposed flush mating surfaces exposed at one edge to vacuum conditions within the pump and at the opposite edge to the ambient atmosphere, at least one of said cooperating members being formed of aluminum, the said surface of the aluminum being hard anodized, and a film of high vacuum grease between such surfaces sealing the interface between said edges against atmosphere leakage thereacross.

4. The invention defined by claim 3 characterized in that said cooperating members are formed of aluminum and the opposed surfaces are hard anodized.

5. The invention defined by claim 3 characterized in that the hard anodizing extends to an average depth of from about one to two mils.

6. The invention defined by claim 3 characterized in that at least some of said cooperating members define a pumping chamber, and the walls of said chamber being aluminum and being hard anodized.

7. The invention defined by claim 3 characterized in that said cooperating members are aluminum and the opposed mating surfaces are hard anodized with at least one of said surfaces provided with an oil groove within which vacuum pump oil is disposed during operating of the pump to effect a seal between said surfaces.

8. The invention defined by claim 3 characterized in that said cooperating members are formed of aluminum and the opposed mating surfaces are hard anodized, at least some of said cooperating members defining a pumping chamber, at least some of said opposed flush mating surfaces surround said chamber and have an edge exposed thereto and another edge exposed to the ambient atmosphere, and the walls of the pumping chamber being hard anodized.

9. The invention defined by claim 8 characterized in that those surfaces surrounding the pumping chamber are provided with an oil groove within which vacuum oil is disposed during operating of the pump to effect a seal between said surfaces.

* * * * *